US010829963B2

(12) United States Patent
Topfer et al.

(10) Patent No.: US 10,829,963 B2
(45) Date of Patent: Nov. 10, 2020

(54) ACTUATING DEVICE FOR A MOTOR VEHICLE LOCK

(71) Applicant: Kiekert Aktiengesellschaft, Heiligenhaus (DE)

(72) Inventors: Claus Topfer, Sindelfingen (DE); Tim Sonnenschein, Velbert (DE)

(73) Assignee: Kiekert AG, Heiligenhaus (DE)

( * ) Notice: Subject to any disclaimer, the term of this patent is extended or adjusted under 35 U.S.C. 154(b) by 251 days.

(21) Appl. No.: 15/129,223

(22) PCT Filed: Mar. 25, 2015

(86) PCT No.: PCT/DE2015/000157
§ 371 (c)(1),
(2) Date: Nov. 8, 2016

(87) PCT Pub. No.: WO2015/149743
PCT Pub. Date: Oct. 8, 2015

(65) Prior Publication Data

US 2017/0107743 A1 Apr. 20, 2017

(30) Foreign Application Priority Data

Mar. 31, 2014 (DE) ..... 10 2014 004 550

(51) Int. Cl.
*E05B 77/06* (2014.01)
*E05B 77/38* (2014.01)
*E05B 77/36* (2014.01)

(52) U.S. Cl.
CPC ..... *E05B 77/06* (2013.01); *E05B 77/38* (2013.01); *E05B 77/36* (2013.01); *Y10S 292/22* (2013.01); *Y10T 292/08* (2015.04); *Y10T 292/57* (2015.04)

(58) Field of Classification Search
CPC ..... E05B 77/06; E05B 77/38; E05B 77/03; E05B 2045/067; E05B 77/36; Y10T 292/57; Y10T 292/08; Y10S 292/22
(Continued)

(56) References Cited

U.S. PATENT DOCUMENTS 3,719,248 A * 3/1973 Breitschwerdt ..... E05B 77/06 180/271
3,799,596 A * 3/1974 Nozomu ..... E05B 77/06 292/216

(Continued)

FOREIGN PATENT DOCUMENTS

DE 29622837 U1 7/1997
DE 10331765 A1 3/2004

(Continued)

*Primary Examiner* — Kristina R Fulton
*Assistant Examiner* — Faria F Ahmad
(74) *Attorney, Agent, or Firm* — Renner, Otto, Boisselle & Sklar, LLP

(57) ABSTRACT

The invention relates to an actuating device for opening a door or flap, comprising a movably supported inertial mass (7, 9) for avoiding unintentional opening of the door or flap in the event that a specified acceleration is exceeded. Levers are provided for moving the inertial mass (7, 9). When the inertial mass (7, 9) is moved out of an initial position of the inertial mass, the lever ratios change in such a way that the force progression is thereby promoted. In the event of a crash, the opening of a door or flap is avoided by means of the actuating device. The actuating device can nevertheless be actuated relatively comfortably with low expenditure of energy.

10 Claims, 3 Drawing Sheets

Figure 1:
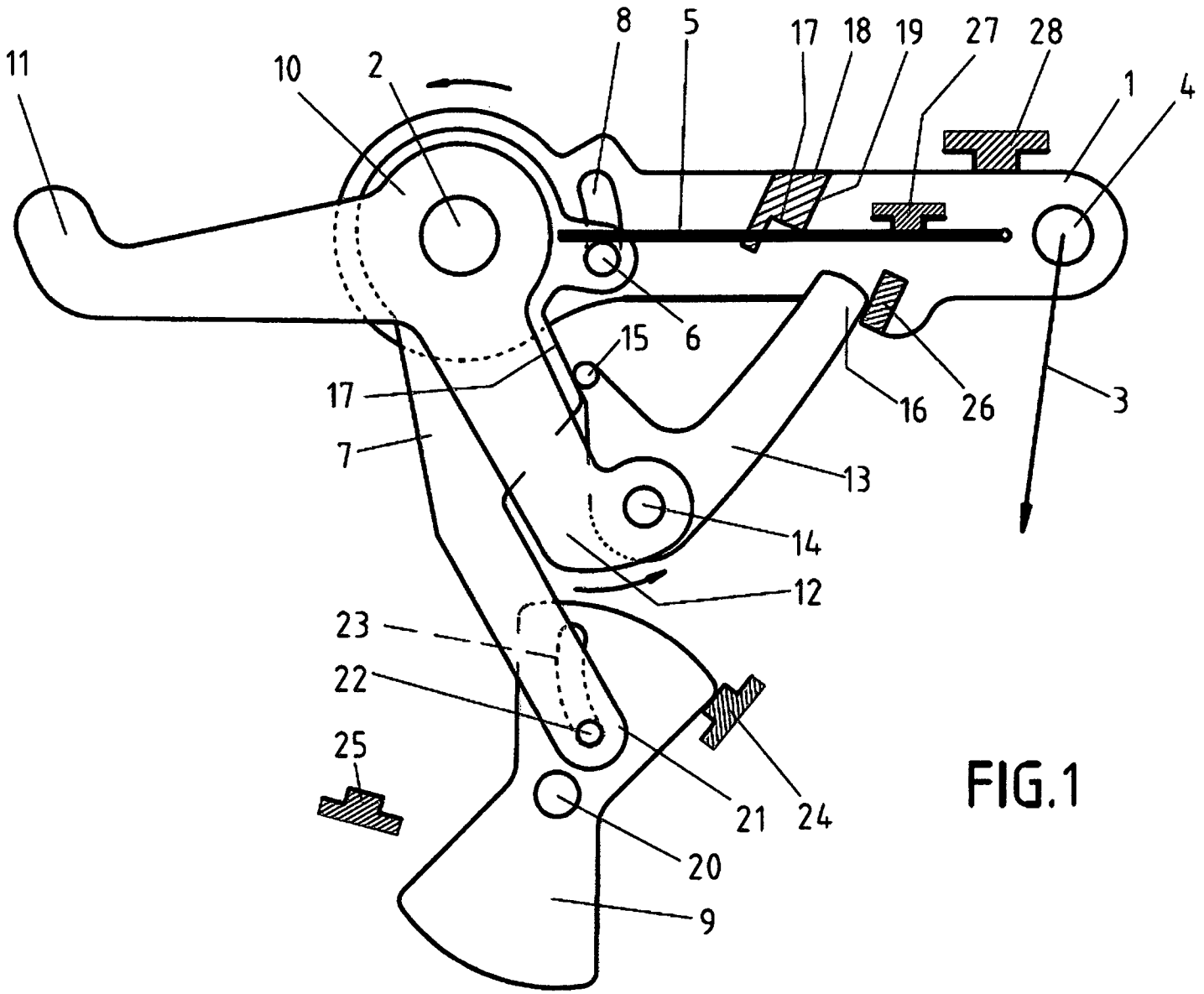

(58) Field of Classification Search
USPC ..... 292/336.3, DIG. 22
See application file for complete search history.

(56) References Cited

U.S. PATENT DOCUMENTS

| | | | | | |
|---|---|---|---|---|---|
| 3,858,921 | A * | 1/1975 | Kuki | E05B 85/18 | 292/336.3 |
| 3,990,531 | A * | 11/1976 | Register | E05B 77/12 | 180/281 |
| 4,155,579 | A * | 5/1979 | Sanok, Jr. | B64G 1/641 | 292/336.3 |
| 4,536,021 | A * | 8/1985 | Mochida | E05B 77/12 | 292/201 |
| 5,092,642 | A * | 3/1992 | Lindmayer | E05B 77/42 | 292/201 |
| 5,669,642 | A * | 9/1997 | Kang | E05B 85/18 | 292/336.3 |
| 5,769,471 | A * | 6/1998 | Suzuki | E05B 77/12 | 292/336.3 |
| 6,007,122 | A * | 12/1999 | Linder | E05B 85/10 | 292/216 |
| 6,042,159 | A * | 3/2000 | Spitzley | E05B 77/06 | 16/111.1 |
| 6,471,262 | B1 * | 10/2002 | Schwab | E05B 77/06 | 242/384.6 |
| 6,575,508 | B2 * | 6/2003 | Stuart | E05B 77/06 | 292/336.3 |
| 6,709,033 | B2 * | 3/2004 | Jooss | E05B 77/06 | 16/412 |
| 6,921,116 | B2 * | 7/2005 | Humes | E05C 1/163 | 292/169 |
| 7,111,880 | B2 * | 9/2006 | Saitoh | E05B 77/04 | 292/336.3 |
| 7,677,614 | B2 * | 3/2010 | Monig | E05B 77/38 | 292/336.3 |
| 8,366,159 | B2 * | 2/2013 | Patel | E05B 77/06 | 292/336.3 |
| 9,109,381 | B2 * | 8/2015 | Lee | E05B 77/06 | |
| 9,194,162 | B2 * | 11/2015 | Perkins | E05B 77/12 | |
| 9,322,198 | B2 * | 4/2016 | Kovie | E05B 85/243 | |
| 9,631,404 | B2 * | 4/2017 | Takagi | E05B 77/32 | |
| 9,637,953 | B2 * | 5/2017 | Bendel | E05B 77/06 | |
| 9,856,675 | B2 * | 1/2018 | Ilardo | E05B 77/42 | |
| 2005/0161959 | A1 * | 7/2005 | Belchine, III | E05B 85/16 | 292/336.3 |
| 2005/0280266 | A1 * | 12/2005 | Mueller | E05B 77/42 | 292/336.3 |
| 2008/0036219 | A1 * | 2/2008 | Savant | E05B 77/06 | 292/336.3 |
| 2010/0225127 | A1 * | 9/2010 | Muller | E05B 77/06 | 292/336.3 |
| 2011/0163554 | A1 * | 7/2011 | Patel | E05B 77/06 | 292/216 |
| 2013/0147211 | A1 | 6/2013 | Lee et al. | | |
| 2013/0221690 | A1 * | 8/2013 | Rocci | E05B 85/16 | 292/336.3 |
| 2013/0234455 | A1 * | 9/2013 | Rocci | E05B 85/16 | 292/336.3 |
| 2014/0292005 | A1 * | 10/2014 | Bendel | E05B 85/10 | 292/336.3 |
| 2016/0069104 | A1 * | 3/2016 | Ilardo | B60J 5/0493 | 292/336.3 |

FOREIGN PATENT DOCUMENTS

| | | | |
|---|---|---|---|
| DE | 102011010816 | A1 | 8/2012 |
| DE | 102011100090 | A1 | 10/2012 |
| DE | 10 2012 110189 | A1 | 6/2013 |
| DE | 20 2012 007312 | U1 | 11/2013 |
| EP | 1 518 983 | A2 | 3/2005 |
| EP | 2 201 202 | A1 | 6/2010 |
| FR | 2 882 386 | A1 | 8/2006 |
| GB | 1 324 131 | A | 7/1973 |
| WO | WO 2009/034035 | A1 | 3/2009 |
| WO | WO 2012/013182 | A2 | 2/2012 |

* cited by examiner

ACTUATING DEVICE FOR A MOTOR VEHICLE LOCK

The invention relates to an activation device for a latch of a door or flap of a motor vehicle. Such a latch has a locking mechanism comprising a catch and a pawl for latching of the catch in a ratchet position and optionally a blocking lever for blocking of the pawl in its ratchet position. The purpose of the activation device is to open the door or flap and it therefore enables unlocking of the locking mechanism. By means of operation of the activation device, the pawl is moved out of its ratchet position and, if necessary, a blocking lever is moved out of its blocking position and the locking mechanism is subsequently opened. The door or flap can subsequently be opened.

The activation device usually has a triggering lever which is operating in order to open or unlock the locking mechanism. Such a triggering lever is typically directly or indirectly connected to a door or flap handle. This can be an external or internal handle of a relevant door or flap. If such a handle is activated, the triggering lever is activated or pivoted to unlock the locking mechanism and thus to open the latch.

In the event of an accident or a vehicle collision, also known as a crash hereafter, very high accelerations usually occur suddenly which can be a multiple of gravitational acceleration. Thus the relevant latch, including the lever systems, such as the activation lever, are exposed to considerable forces which can lead to an unwanted opening of the locking mechanism and consequently an opening of the pertaining latch. In the case of a crash, the activation lever, i.e. an internal or external door handle, can also be unintentionally operated which would also lead to an opening of the locking mechanism.

Due to the described scenarios, considerable risks result for the vehicle users. Because an unintentionally opened motor vehicle door can no longer provide the safety devices present in it, such as a lateral airbag or lateral impact protection, for the protection of the vehicle occupants. Thus, mechanisms are provided for with so-called mass inertia locks in order to prevent opening of a door or a flap when excessively high acceleration forces occur, as is the case in a crash.

Such a mechanism has a movable inert mass which needs to be moved for the opening of a door or a flap. If this movable inert mass is not moved or is not moved quickly enough in the case of operation of an external door handle, the mechanism prevents the locking mechanism from opening. A mechanism which is capable of achieving this is known, for example, from the publications EP 1 518 983 A2 or WO 2012/013182 A2.

If an inert mass needs to be moved to open the locking mechanism, a force must be applied to this end. In the case of unlocking by an electrical drive, electrical energy needs to be applied to this end. In the case of mechanical opening, the movement of the inert mass increases the application of force. The ease of use is reduced as a result.

It is the task of the invention to provide an activation device which is capable of preventing unintentional opening of a door or a flap in a crash and which is nevertheless enables convenient opening of a door or flap with little energy expenditure.

In order to solve the task, an activation device encompasses the features of the first claim. Advantageous designs arise from the sub claims. Insofar as not stated otherwise hereinafter, the activation device can encompass the initially stated features known from the state of the art, individually or in any combination.

In order to solve the task, an activation device is provided for a door latch or a flap latch which encompasses a movably located inert mass for prevention of unintentional opening of a door or a flap on exceeding a specified acceleration. By inert mass for the purpose of the present invention, one or several components of the activation device are meant which are not moved or not moved quickly enough at high accelerations, which causes a locking mechanism of a latch to not be opened.

Levers are provided for moving the inert mass out of an initial position and associated opening of a connected latch. The lever ratios change if the inert mass is moved out of its initial position under usual acceleration of a part of the activation device. It is thus possible that for operation and associated movement of the inert mass a maximum force and/or maximum torque initially need to be applied. At the start of operation, there is therefore a maximum force or maximum torque for movement of the inert mass out of its initial position. Hereinafter, a—compared to this maximum force or torque—reduced force or torque needs be applied for such further movement of the inert mass in order to be able to open the door or flap. Meant is a change in force or torque based on the change in the lever ratios. No change in force or torque is meant based on a resting inert mass initially needing to be accelerated and on applying a force for the acceleration which however ceases to apply as soon as the desired final speed has been attained.

A pertaining door or flap cannot be opened unintentionally by high accelerations due to the activation device according to the claim and can nevertheless be opened intentionally in a mechanically convenient manner as a relatively high force or a relatively high torque for movement of the inert mass must be applied initially. In the case of opening by an electrical drive the electrical energy to be applied is kept low.

In one design, the lever ratios change in such a way that the inert mass or at least a component of the inert mass is increasingly moved more slowly for opening of the locking mechanism relatively to the movement speed of an activation lever . The inert mass or at least a component of the inert mass must be moved relatively quickly initially to open the locking mechanism. Subsequently, the movement of the inert mass or the component of the inert mass decelerates relatively to the speed of an activation lever which is pivoted to open a door or a flap. If a mass is set into motion, a relatively large force must always be applied initially in order to accelerate the mass to the desired speed. Subsequently, only such a force needs to be applied which is necessary to maintain the speed. In the aforementioned design it is not necessary to maintain an attained speed. The force to be applied can even cease to apply completely in contrast to the state of the art in which an inert mass must be moved further uniformly as for an activation lever for opening.

The aforementioned speed is in particular an angular speed, also known as a rotational speed or pivoting speed. The inert mass or at least a component of the inert mass is then pivotably located and rotated around its axis during opening. The rotation speed of the inert mass or the component of the inert mass is initially relatively high and finally reduces increasingly in relation to the speed or angular speed of an activation lever which needs to be pivoted to open the door or flap.

One or several levers are preferably part of the inert mass in order to minimize the installation space and the weight and number of components.

In one design form of the invention, the inert mass or a component which forms the inert mass or is part of the inert mass is pivotably supported on an axis. If this component of the inert mass is in its initial position, the application point for movement of the component is located close to its axis. If this component of the inert mass is moved out of its initial position, the distance between the axis and the application point increases. Due to the change in the distance between the axis and the application point, the lever ratios for movement of the inert mass or of at least a component of the inert mass change in the envisaged manner. The change in lever ratios can thus be implemented in a technically simple manner.

In one design, the application point is formed by a bolt reaching into a lengthwise hole or a recess, in particular a slit-shaped recess. The bolt can move along the lengthwise hole or the recess, whereby lever ratios are changed. A suitable movable application point can thus be created in a technically simple manner. The bolt is advantageously of a cylindrical shape, whereby the lengthwise hole has cooperating flanks, in particular one as a describable cross-sectional shape.

By the bolt reaching into a lengthwise hole or a slit, a defined connection is advantageously ensured in which the location of the components to one another is specified within the scope of movement. Advantageously bolts and/or lengthwise holes are part of the inert mass in order to thus keep the installation space and the weight low.

In one design, the lengthwise hole or slit is arc-shaped in order to further increase convenience for mechanical opening or to minimize the energy to be applied for electrical opening. In order to move the component of the inert mass out of its initial position, the bolt then exerts a force onto the external edge of the arc if the activation device is activated.

In one design of the invention, the mass of the rotatable component which acts as an inert mass or part of the inert mass increases with increasing distance from its axis. Advantageously, an inert mass with a relatively low weight can be used by means of this design which can nevertheless prevent opening of the latching device at excessively high accelerations.

In a constructionally simple and reliable design of the invention, the mechanism provided for movement of the inert mass encompasses a spring. A force exerted by an activation lever is conducted into the inert mass via the spring. At low accelerations, the spring behaves as a rigid body, whereby the inert mass is moved out of its initial position for opening of the latching device. When exceeding a specified acceleration, the spring does not behave like a rigid body so that the inert mass is moved out of its initial position for opening of the locking mechanism. The locking mechanism is not unlocked, the door or flap does not therefore open.

What mass inertia locks according to the state of the art have in common is that the mass inertia moment is activated at a fixed point on the circumference or application point. A fixed application point hereby implies a fixed, unchangeable mass moment on the triggering chain.

The present invention is distinguished from this known state of the art and enables a changeable, settable and angle-dependent mass inertia moment of the triggering chain to be provided in order to thus reduce force and energy expenditure compared to such a state of the art.

The invention is explained in further detail hereafter on the basis of is an execution example.

Figure 2:
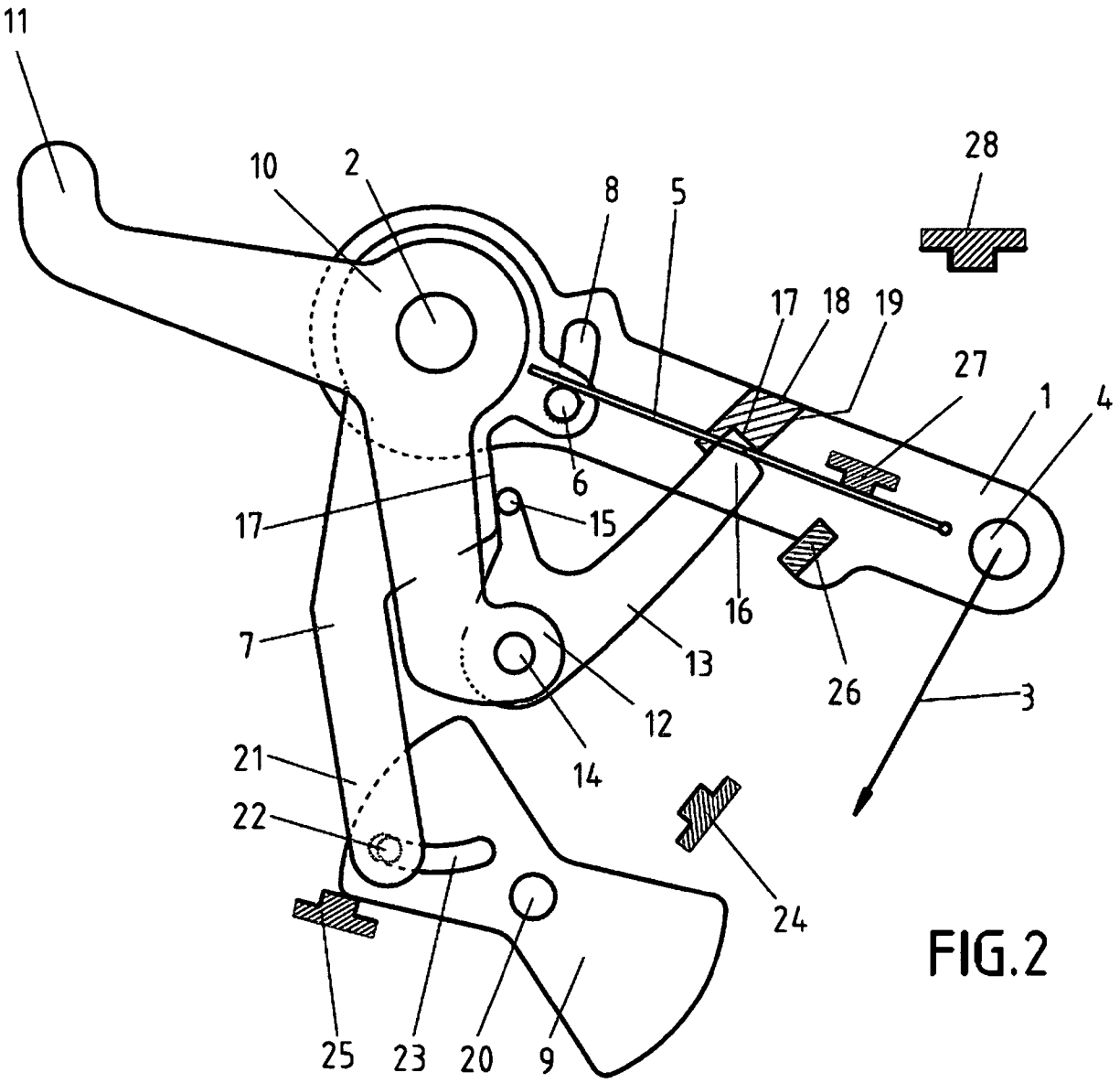
Figure 3:
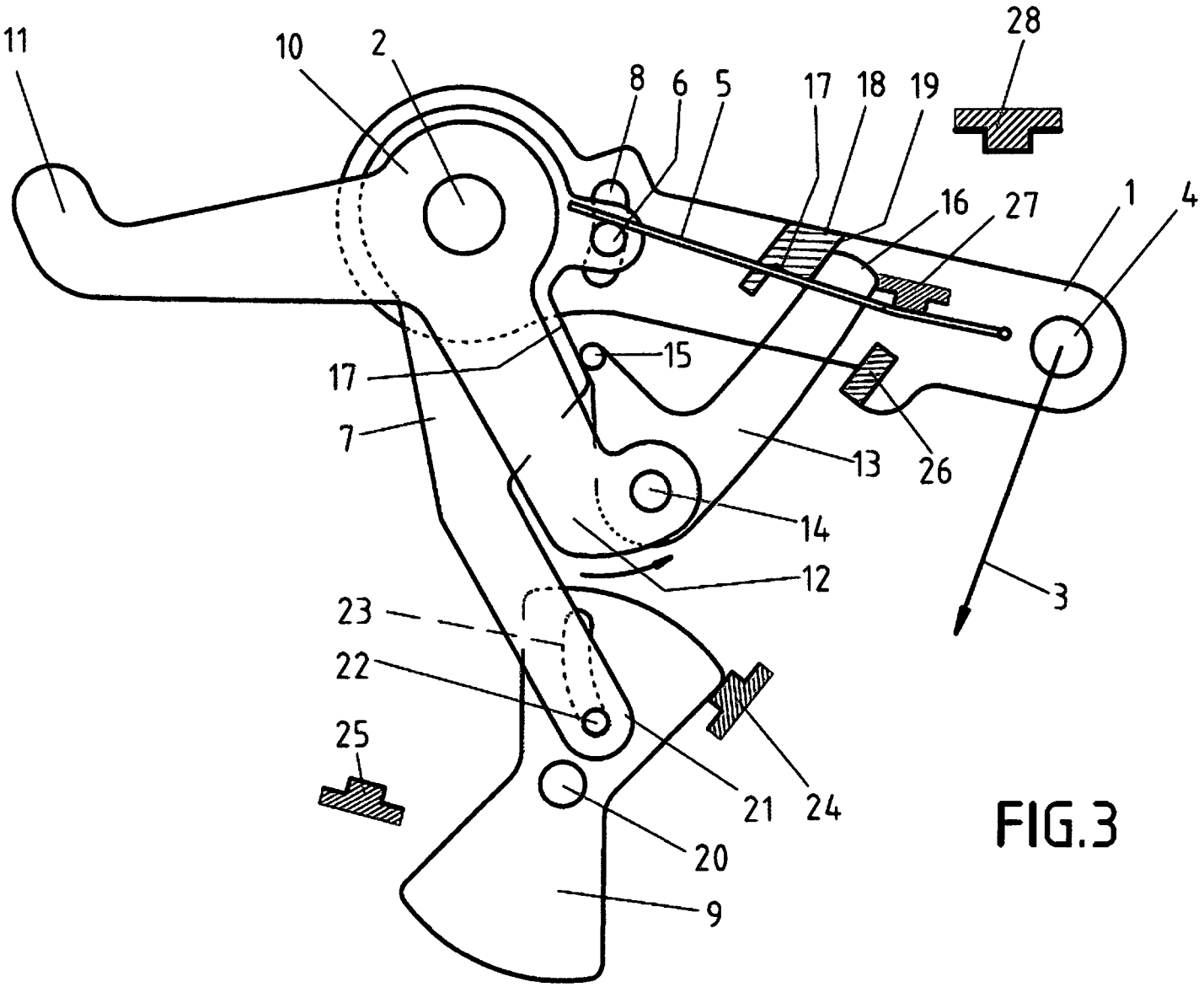

The following are shown:

FIG. 1: Mechanism of an activation device in the initial position;

FIG. 2: operated mechanism;

FIG. 3: Mechanism following great acceleration.

FIG. 1 shows a mechanism of an activation device for unlocking or opening of a non-illustrated locking mechanism, namely in an initial position in which the activation device is not operated. The mechanism encompasses an external activation lever 1 pivotably attached by an axis 2 to a non-illustrated latch plate or a housing of the activation device. The latch plate or the housing can at the same time be part of a non-illustrated latch, which encompasses a locking mechanism.

The external activation lever 1 is connected via a Bowden cable 3, a rope or a rod with a non-illustrated external door handle. The free end of the external activation lever 1 has an attachment facility 4 for the rope, rod or Bowden cable 3. If the handle is activated, the external activation lever 1 is pivoted around the axis 2 in a clockwise direction with the aid of the rope, the rod or the Bowden cable 3.

One end of a leaf spring 5 is attached to the external activation lever 1 adjacent to the attachment facility 4. The leaf spring 5 extends in the direction of the axis 2 of the external activation lever and ends adjacent to a bolt 6. The spring 5 fits closely against the bolt 6. The bolt 6 is attached to a pivotable control lever 7 which is also pivotably supported on the mentioned axis 2. The control lever 7 is part of the inert mass as it needs to be moved in order to open a door or flap and it is not suitably moved in the case of excessively high accelerations. In this design, the control lever 7 is located above the external activation lever 1. The bolt 6 extends both upwards and downwards and upwards in such a way that the bolt 6 is located adjacent to the free end of the leaf spring 5. The bolt 6 extends downwards into a lengthwise hole 8 of the external activation lever. In the rotational direction of the external activation lever 1, i.e. viewed in a clockwise direction, the bolt 6 is arranged behind the leaf spring 5 and is adjacent to a relevant end of the lengthwise hole 8 in the starting position. This end of the lengthwise hole 8 thus limits a pivoting movement of the control lever 7 in a clockwise direction and namely relatively to the external activation lever 1. The lengthwise hole can also limit the rotational movement of the control lever 7 in an anti-clockwise direction relative to the external activation lever 1.

If the external activation lever 1 is accelerated with usual acceleration, the leaf spring 5 behaves as a rigid body. The free end of the leaf spring 5 then conducts a force into the bolt 6 and rotates it and thus also the control lever 7 in a clockwise direction around the axis 2. If the external activation lever 1 is accelerated with high acceleration, the leaf spring 5 does not behave like a rigid body. This is because the spring force of the leaf spring 5 is not sufficient to accelerate the control lever 7 and a connected further component 9 of the inert mass quickly enough.

A triggering lever 10 is pivotably supported above the control lever 7 by the axis 2. The triggering lever 10 encompasses a lever arm 11, with which a non-illustrated pawl or a non-illustrated blocking lever of the locking mechanism can be moved out of its ratchet or blocking position by pivoting of the lever arm 11 in a clockwise direction in order to thus open, i.e. unlock, the locking mechanism. However, this pivoting of the lever arm 11 in a clockwise direction is only possible if the control lever 7 is also pivoted in a clockwise direction by operation of the activation device, as explained hereinafter.

The triggering lever 10 encompasses another lever arm 12. Below the free end of the lever arm 12 a coupling lever 13 is pivotably attached by an axis 14 to this free end. By means of a non-illustrated spring, the coupling lever 13 is pre-tensioned in respect of the further lever arm 12 of the triggering lever 10 in such a way that this spring is capable of moving the coupling lever 13 in an anti-clockwise direction, namely around the axis 14. However, such a rotation in an anti-clockwise direction is prevented in the starting position illustrated in the FIG. 1 because the free end 15 of a lever arm of the coupling lever 13 fits closely against a lateral contour 17 of the control lever 7. The free end 15 can encompass a vertically protruding bolt which is capable of fitting closely against the contour 17. The stepwise process of the lateral contour, shown in FIG. 1 starting from the area 17 in the direction of the end with the bolt 22, promotes the desired movement process described below and reduces the use of mass and thus weight.

A pivoting of the control lever 7 in a clockwise direction enables a rotational movement of the coupling lever 13 around the axis 14 in an anti-clockwise direction. If the coupling lever 13 is pivoted by the non-illustrated spring in an anti-clockwise direction, a free end 16 of a further lever arm of the coupling lever 13 engages into a stepped recess 17 of a towing arm 18, as can be seen in FIG. 2. The towing arm 18 with the stepped recess 17 is attached on the external activation lever. If the lever arm end 16 of the coupling lever 13 has been moved into this stepped recess 17, the consequence of pivoting the external activation lever 1 in a clockwise direction is that the activation lever 10 is then also pivoted in a clockwise direction. Operation of the handle at normal acceleration therefore pivots the external activation lever 1 in a clockwise direction. This rotational movement of the external activation lever 1 in a clockwise direction is transferred via the leaf spring 5, acting as a rigid body, on the control lever 7 which is then also pivoted in a clockwise direction around the common axis 2. The pivoting of the control lever 7 in a clockwise direction releases the lever arm end 15 of the coupling lever 13 and thus enables pivoting of the coupling lever 13 around its axis 14 in a clockwise direction. By means of this rotational movement of the coupling lever 13, the free end 16 of a lever arm of the coupling lever engages into the step 17 of the towing arm 18. If the free end 16 is located in the step 17 of the towing arm 18, the rotating movement is transferred via the coupling lever 13 onto the activation lever 10 and thus the free end 11 of a lever arm of the activation lever is pivoted for an opening of the locking mechanism in the clockwise direction, as shown in FIG. 2.

If the external activation lever 1 is accelerated and pivoted excessively quickly, the leaf spring 5 does not behave like a rigid body due to the inertia of the control lever 7 and the component 9 of the inert mass. The control lever 7 cannot be pivoted or cannot be pivoted quickly enough around its axis 2 in a clockwise direction. The consequence of this is that the coupling lever 13 is also not pivoted around its axis 14 in an anti-clockwise direction and thus does not engage into the stepped recess 17 of the towing arm 18. Instead, the free end 16 of one lever arm of the coupling lever 13 is moved past on the step 17 and moves adjacent to the lateral contour 19 of the towing arm 18, as shown in FIG. 3. If this happens as shown in FIG. 3, the free end 16 can no longer enter the stepped recess 17. Further pivoting of the external activation lever 1 in a clockwise direction can therefore not cause the activation lever 10 to also be pivoted in a clockwise direction for opening of the locking mechanism. In the case of excessively high acceleration, the locking mechanism will therefore not open.

The component 9 of the inert mass is attached to a latch plate or a housing by an axis 20. It can be the same latch plate or the same housing to which the axis 2 is attached. The control lever 7 encompasses a free lever arm end 21. A bolt 22 is attached at this free end 21 which engages into an arc-shaped lengthwise hole 23 of the component 9 of the inert mass. In the starting position, the cylindrical bolt 22 is located close to the axis 20.

If the activation device is intentionally accelerated for opening a door or a flap, i.e. not excessively quickly, the control lever 7 is pivoted in a clockwise direction. This pivoting of the control lever 7 in a clockwise direction exerts a force on the external arc-shaped edge of the lengthwise hole 23 of the component 9 of the inert mass. A force is thus conducted into the component 9 of the inert mass. The component 9 can therefore also be described as a mass element. The component 9 of the inert mass thereupon rotates in an anti-clockwise direction. The consequence of this is that the bolt 22 of the control lever 7 changes its position within the lengthwise hole 23 of the component 9 of the inert mass and is moved from one end of the lengthwise hole 23 in the direction of the other end of the lengthwise hole 23. The lever ratios change as a result. The lever ratios change in such a way that the rotational speed of the component 9 decelerates relatively to the rotational speed of the control lever 7 and the rotational speed of the external activation lever and the activation lever 10. The lever ratios change in such a way that only initially a relatively large force needs to be conducted into the component 9 of the inert mass in order to be able to open a pertaining door or flap.

The component 9 of the inert mass is of a rotationally symmetrical construction apart from the lengthwise hole 23 in order to be able to advantageously execute rotational movements in as vibration-free a manner as possible. This inter alia contributes to low-noise opening. In the direction of the axis 20, around which the component 9 of the inert mass can be pivoted, there is a constriction similar to the number '8'. Hereby it is attained that the material or the mass of the component 9 of the inert mass increases with increasing distance from the axis 20. This contributes to the mass and weight of the component 9 of the inert mass being able to be kept low and to provide as high a mass inertia moment as possible on the starting point of the movement for the control lever 7.

The lengthwise hole 23 of the component 9 of the inert mass can simultaneously act to suitably limit pivoting of the component 9. Alternatively or additionally, stops 24 and 25 can be provided for which suitably limit the pivoting movements of the component 9. The activation device can include further stops which ensure the proper position and location of components. Thus, the external activation lever 1 can have a stop 26 which limits a pivoting movement of the coupling lever 13 in a clockwise direction. Hereby, inter alia, the location of the activation lever 11 can be fixed in the starting position. A stop 27 can be provided for the leaf spring 5 in order to stabilize the leaf spring 5. A stop 28 can be provided for the external activation lever 1 which limits a pivoting movement into the starting position, i.e. a pivoting movement in an anti-clockwise direction. Stops are advantageously executed as damping elements which therefore have a yielding, for example an elastomer surface to attenuate noises.

In the figures the component 9 of the inert mass is reproduced in the form of a flattened '8', which fits closely against a damping element in the resting state as depicted in FIG. 1. The inert mass of the component 9 hereby interacts with the control lever 7 which can be operated via the external activation lever 1 in turn. The principle of a changing application point on a mass element or component 9 can in principle also be transferred to other mass locks.

It is of particular importance that the application point of the control lever 7 changes on the component 9 of the inert mass during operation of the control lever 7. The control lever 7 engages into a contour of the component 9 of the inert mass, whereby the application point is initially arranged close to the rotational point, or the rotational axis 20 of the component 9. Hereby, favorable lever ratios and a high mass inertia moment result that counteract the triggering chain of external activation lever 1, coupling lever 13, activation lever 10. Once deflected, the engagement ratios change between the component 9 of the inert mass and the control lever 7. Consequently, only especially small forces are necessary to move the inert mass of the component 9. An exemplary location of the inert mass of the component 9 is shown in a position pivoted around approx. 90° in FIGS. 1 and 2.

In contrast to the location of the component 9 exemplarily depicted in FIG. 3 the component 9 can also reach the position depicted in FIG. 2. In this position the component 9 can be held in the deflected position via a non-illustrated fixing device. If the component 9 is deflected and fixed, the control lever 7 can thus not get into its starting position shown in FIG. 1. Thus, the coupling lever 13 remains in its coupled position, whereby an opening of the locking mechanism by bouncing is also prevented. The coupling lever 13 remains uncoupled as the external activation lever 1 cannot be moved back into its starting position. The external activation lever 1 is prevented from moving back by the close fit of the bolt 6 against the end of the lengthwise hole 8.

REFERENCE SIGN LIST

1: External activation lever
2: Axis for external activation lever
3: Bowden cable
4: Fixing for Bowden cable
5: Leaf spring
6: Bolt of a control lever
7: Control lever
8: Lengthwise hole in the external activation lever
9: Component of an inert mass
10: Activation lever
11: Lever arm for the activation lever for opening the locking mechanism
12: Lever arm end of the activation lever
13: Coupling lever
14: Axis for coupling lever
15: Lever arm end of the coupling lever
16: Lever arm end of the coupling lever
17: Stepped recess of a towing arm
18: Towing arm for coupling lever
19: External side of the towing arm for coupling lever
20: Axis for component of the inert mass
21: Lever arm of the control lever
22: Bolt of the control lever
23: Lengthwise hole in a component of the inert mass
24: Stop for inert mass
25: Stop for inert mass
26: Stop for coupling lever
27: Stop for spring
28: Stop for external activation lever

The invention claimed is:

1. A motor vehicle door latch comprising:

an activation device for opening of a door or a flap; and a movably supported inert mass for prevention of unintentional opening of the door or flap due to exceeding of a specified acceleration, wherein the inert mass is formed of a control lever and a pivotably supported component that is movably connected to the control lever at a moving application point, wherein the activation device is configured to move the control lever for movement of the inert mass from an initial position to an opening position, wherein the control lever has a bolt and the pivotably supported component has a lengthwise hole or recess that is elongated and in which the bolt is received to form the moving application point between the control lever and the pivotably supported component, wherein the bolt is movable along the hole or recess between opposite ends of the hole or recess, wherein the hole or recess is formed by an enclosed wall that confines movement of the bolt within the hole or recess, whereby pivoting of the pivotably supported component is limited, wherein during movement of the inert mass from the initial position to the opening position, a distance between a central axis defined by the bolt, that forms the moving application point, and a pivot axis of the pivotably supported component increases in a plane of rotation of the pivotably supported component.

2. The motor vehicle door latch according to claim 1, wherein the activation device includes an external activation lever, wherein the component of the inert mass is capable of rotating together with the external activation lever of the activation device, and a rotational speed of the component of the inert mass reduces relatively to a rotational speed of the external activation lever during operation of the activation device.

3. The motor vehicle door latch according to claim 1, wherein the lengthwise hole or the recess is arc-shaped in such a way that the bolt is capable of conducting a force into an external arc of the lengthwise hole or the recess by activation.

4. The motor vehicle door latch according to claim 1, wherein the component of the inert mass tapers in a direction of the rotational axis.

5. The motor vehicle door latch according to claim 1, wherein the activation device provided for the movement of the inert mass encompasses a spring which behaves like a rigid body at low accelerations when the inert mass is moved out of the initial position for the opening of the door or the flap, and wherein when exceeding a specified acceleration, the spring enables the inert mass to be moved out of the initial position for opening.

6. The motor vehicle door latch according to claim 1, wherein the control lever and the component of the inert mass have lever ratios which change.

7. The motor vehicle door latch according to claim 6, wherein a lever for the provision of changing lever ratios is the pivotable control lever which controls the movement of the component of the inert mass.

8. The motor vehicle door latch according to claim 6, wherein a lever for the provision of changing lever ratios is provided by the pivotably supported component of the inert mass.

9. The motor vehicle door latch according to claim 1, wherein the activation device for the opening of the door or the flap encompasses an activation lever for opening of a locking mechanism.

10. A latching device according to claim 1, further comprising a locking mechanism consisting of a catch and a pawl, whereby the locking mechanism can be unlocked by activation of the activation device.

* * * * *